US011161652B1

(12) United States Patent
Engelking

(10) Patent No.: US 11,161,652 B1
(45) Date of Patent: Nov. 2, 2021

(54) DRAWSTRING TRASH BAG

(71) Applicant: Poly-America, L.P., Grand Prairie, TX (US)

(72) Inventor: Jarred R. Engelking, Irving, TX (US)

(73) Assignee: Poly-America, L.P., Grand Prairie, TX (US)

( * ) Notice: Subject to any disclaimer, the term of this patent is extended or adjusted under 35 U.S.C. 154(b) by 0 days.

(21) Appl. No.: 17/016,739

(22) Filed: Sep. 10, 2020

(51) Int. Cl.
*B65D 33/28* (2006.01)
*B65F 1/00* (2006.01)

(52) U.S. Cl.
CPC ..... *B65D 33/28* (2013.01); *B65F 1/002* (2013.01)

(58) Field of Classification Search
CPC ..... B65D 33/28; B65F 1/002
USPC ..... 383/75
See application file for complete search history.

(56) References Cited

U.S. PATENT DOCUMENTS 1,861,864 A * 6/1932 Kennedy ..... B65D 33/28 383/75
4,762,430 A * 8/1988 Bullard ..... B65D 33/28 383/75
6,059,458 A * 5/2000 Belias ..... B65D 33/28 220/495.11
9,555,932 B2 * 1/2017 Tseng ..... B65D 33/165
9,586,726 B1 * 3/2017 Moody ..... B65D 33/28
2010/0046860 A1 * 2/2010 Kent ..... B65F 1/0006 383/75

FOREIGN PATENT DOCUMENTS

GB 2009098 A * 6/1979 ..... B65D 33/28

* cited by examiner

*Primary Examiner* — Jes F Pascua
(74) *Attorney, Agent, or Firm* — Daniel J. Layden; Brandon J. Lee

(57) ABSTRACT

The present invention is directed to a drawstring bag comprising a first panel and a second panel. The first panel and the second panel are joined along a first side, a bottom, and a second side. The first panel and the second panel thereby define an upper opening of the bag. The drawstring bag may further comprise a wave shaped drawstring disposed within a first hem along the upper opening of the bag in the first panel and a second wave shaped drawstring disposed within a second hem along the upper opening of the bag in the second panel. Each of the wave shaped drawstrings may be out stretched prior to insertion into the corresponding hem to narrow the upper opening of the bag to provide for the bag gripping the openings of trash containers.

20 Claims, 6 Drawing Sheets

DRAWSTRING TRASH BAG

CROSS-REFERENCE TO RELATED APPLICATIONS

Figure 1:
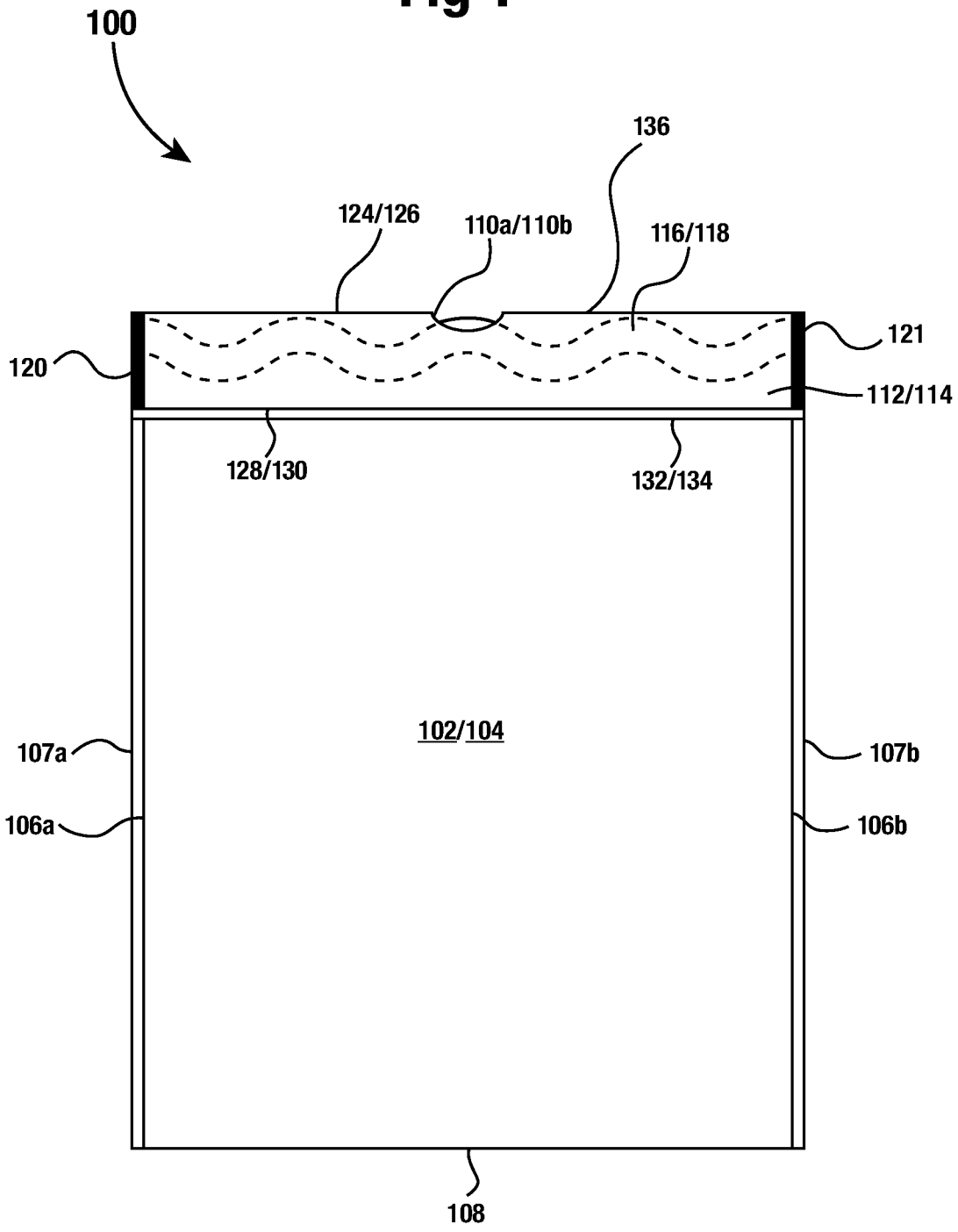

Not applicable.

BACKGROUND OF THE INVENTION

1. Field of the Invention

The present invention relates to improvements in polymeric bags. Specifically, the present invention relates to polymeric bags utilizing a drawstring typically used for trash or refuse disposal. Moreover, the present invention relates to polymeric bags utilizing an elastic drawstring.

2. Description of the Related Art

Polymeric bags are ubiquitous in modern society. Polymeric bags can be manufactured using woven polymeric materials or manufactured using thin polymeric films with one or more material layers. Applications for which polymeric bags may be utilized are numerous with variations of polymeric bags used in a number of different industries. Moreover, some polymeric bags may exhibit certain properties depending on the specific polymeric materials used in the manufacturing process.

The present invention relates primarily to thin-film bags, typically polyethylene bags, used for trash or garbage collection. Such bags are typically manufactured using a blown-film extrusion process, providing a film material for the trash bag body which is subsequently converted into a final product. Polyethylene trash bags are available in different sizes, thicknesses, and colors and typically incorporate one of three different closure methods: straight top bags with twist tie closures; flapped bags where the flaps can be used to secure, tie, and carry the bag; and drawstring trash bags where a drawstring is provided within the hems of the bag to provide a method for securing, tying, and carrying the trash bags. The present invention is of particular relevance to drawstring trash bags.

Over the past decade drawstring trash bags have enjoyed increasing commercial success as consumers recognize such bags utility. This is particularly true with respect to domestic household use where drawstring trash bags are now the most popular type of trash bags used in such settings.

Such drawstring bags typically feature a drawstring located within each hem and anchored to the upper corners of the bag. The drawstrings can be used to pull the trash bag closed, to secure the trash bag mouth closed by tying the drawstrings closed, and to provide handles for carrying the closed, filled trash bag. Traditionally, such drawstrings were manufactured using primarily high density polyethylene, which offers increased tensile strength when compared to linear low density polyethylene or low density polyethylene. However, new improved drawstrings are emerging which provide other features and functions, particularly with respect to securing the top of the drawstring trash bag onto a trash receptacle.

One solution for gripping the top of a trash receptacle is described in U.S. Pat. No. 5,133,607 (the '607 patent) entitled "Plastic Liner Bag with Elastic Top Tie Strip." The '607 Patent, which is incorporated herein by reference, describes using an elastic drawstring or band within the top of the drawstring bag. The elastic drawstring can be pulled outward at the top corners of the bag. The elastic tie top requires relatively expensive elastomeric materials and a thicker gauge than traditional high density drawstrings.

Solutions have also been described for securing the top of the drawstring trash bag onto a trash receptacle using multiple draw tape elements. For instance, U.S. Pat. No. 6,164,824 (the '824 patent) entitled "Garbage Bag with Elastic Rim Edge Support," describes an elastic loop with a rest diameter, the elastic loop located within an upper edge of a loop space of a trash bag. The elastic loop is pulled over an outer rim of a trash receptacle to a stretch diameter. The bag is described as being fixed to the garbage receptacle as the elastic element attempts to resume its rest diameter. The '824 patent also describes a loop shaped plastic cinch element located in the same upper edge of the loop space that may extend outside an opening of the upper edge of the loop space which may be used to tie the top end of the garbage bag. Both the cinch element and the elastic element are described as a continuous loop. The '824 patent discloses costly and difficult to manufacture materials for the cinch element, such as a band of fibrous material. The '824 patent also discloses relatively expensive and bulky materials for the elastic element, such as natural rubber, that is only capable of carrying a small fraction of the weight of a full trash bag.

Another solution involving multiple drawstring elements includes U.S. Pat. No. 6,585,415 (the '415 patent) entitled "Expandable Garbage Bag." The '415 patent describes a drawstring garbage bag with inextensible ribbons disposed within hems at an upper opening of both sides of the bag. Further described is an elastic ribbon inserted into one of the two hems. Provided in at least the hem containing the elastic ribbon is a hole for accessing the ribbon. The elastic ribbon is configured so that it may be pulled out of the hem, once the bag has been placed in a container, and the hem wrapped over the top edge of the container, twisted, and wrapped around the outer circumference of the bag around the container to affix the bag to the container. The elastic ribbon requires a highly elastic material for stretching over the entire outer rim of a receptacle, adding considerable manufacturing costs to the garbage bag.

Another approach to improving drawstring trash bags is described in United States Published Patent Application No. 2011/0052103 (the '103 Application) entitled "Elastic Drawstring for Trash Bags," assigned to Applicant and hereby incorporated into this disclosure by reference in its entirety. The '103 Application discloses a blend of linear low-density polyethylene (LLDPE) and low-density polyethylene (LDPE) to provide a drawstring with elastic-like properties. Specifically, when the two polyethylene resins are used together as described in the patent application, the resultant material provides limited elastic properties, with the blended draw tape exhibiting a greater percentage of elongation before yielding than either of the two materials would exhibit alone. Moreover, a 3 mil draw tape according to the '103 Application can provide elastic recovery of approximately 80%, which is greater than either the LLDPE or the LDPE materials would exhibit individually.

A further improvement to the blended LLDPE and LDPE drawstring of the '103 Application is described in United States Published Patent Application No. 2014/0254958 (the '958 Application) entitled "Cold-Stretched Drawstring Trash Bag", assigned to Applicant and hereby incorporated by reference in its entirety into this disclosure. The '958 Application discloses a cold-stretch process applied to draw tape film that strain hardens the film, increasing the tensile strength at yield, and decreasing the elongation at yield of the film.

It would be advantageous to further improve the properties of the drawstring trash bag described in the '103 Application. For instance, it would be advantageous to improve the range of containers that a drawstring trash bag may be affixed to by using common polyethylene materials, such as high density polyethylene, linear low density polyethylene, and low density polyethylene. The above described '103 and '958 applications describe a bag that is capable of adhering to receptacle openings within a limited range. The below described invention provides a drawstring bag capable of easily adhering to a greater range of container openings while still being manufactured with the aforementioned common and low-cost polyethylene materials.

SUMMARY OF THE INVENTION

The present invention is directed to a drawstring bag comprising a first panel and a second panel. The first panel and the second panel can be joined along a first side, a bottom, and a second side. The first panel and the second panel define an upper opening of the bag. The drawstring bag can further comprise a first hem located along the upper opening of the bag in the first panel. Inserted into the first hem can be a first drawstring. The first drawstring can have a wave-shape. The first panel, the second panel, and the first drawstring can be welded together proximate to the first side. Additionally, the first panel, the second panel, and the first drawstring can be welded together proximate to the second side.

In at least one embodiment of the present invention, the wave-shape of the first drawstring can be elongated after insertion into the hem such that the wave shape is deformed. The first panel, the second panel, and the first drawstring can be welded together proximate to the first side by a first short seal. The first panel, the second panel, and the first drawstring can be welded together proximate to the second side by a second short seal. The first drawstring can be elastic and have a sinusoidal wave shape. The upper opening of the bag can be narrowed due to the first drawstring retracting after attachment to the bag. Additionally, the first drawstring can have a width between ¾ inch and 1¼ inch. The wave-shape of the first drawstring can have an amplitude between ¾ inch and 1.5 inches. The wave-shape of the first drawstring can also have a wavelength of at least four inches and no more than six inches.

In a further embodiment of the present invention, a drawstring bag may comprise a first panel and a second panel. The first panel and the second panel can be joined along a first side, a bottom, and a second side. The first panel and the second panel can define an upper opening of the bag. The drawstring bag can further comprise a first hem located along the upper opening of the bag in the first panel. Inserted into the first hem can be a first drawstring. The first drawstring can be a sinusoidal wave-shape. The first panel, the second panel, and the first drawstring can be welded together proximate to the first side. Additionally, the first panel, the second panel, and the first drawstring can be welded together proximate to the second side.

In an additional embodiment of the present invention, a drawstring bag may comprise a first panel and a second panel. The first panel and the second panel can be joined along a first side, a bottom, and a second side. The first panel and the second panel can define an upper opening of the bag. The drawstring bag can further comprise a first hem located along the upper opening of the bag in the first panel. Inserted into the first hem can be a first drawstring. The first drawstring can be a wave-shape. The upper opening of the bag can be narrowed due to the first drawstring retracting after attachment to the bag. The first panel, the second panel, and the first drawstring can be welded together proximate to the first side. Additionally, the first panel, the second panel, and the first drawstring can be welded together proximate to the second side.

It is contemplated that the present invention may be utilized in ways that are not fully described or set forth herein. The present invention is intended to encompass these additional uses to the extent such uses are not contradicted by the appended claims. Therefore, the present invention should be given the broadest reasonable interpretation in view of the present disclosure, the accompanying figures, and the appended claims.

BRIEF DESCRIPTION OF THE RELATED DRAWINGS

A full and complete understanding of the present invention may be obtained by reference to the detailed description of the present invention and preferred embodiments when viewed with reference to the accompanying drawings. The drawings can be briefly described as follows.

FIG. 1 provides a side view of a drawstring trash bag 100 according to one embodiment of the present invention.

Figure 2A:
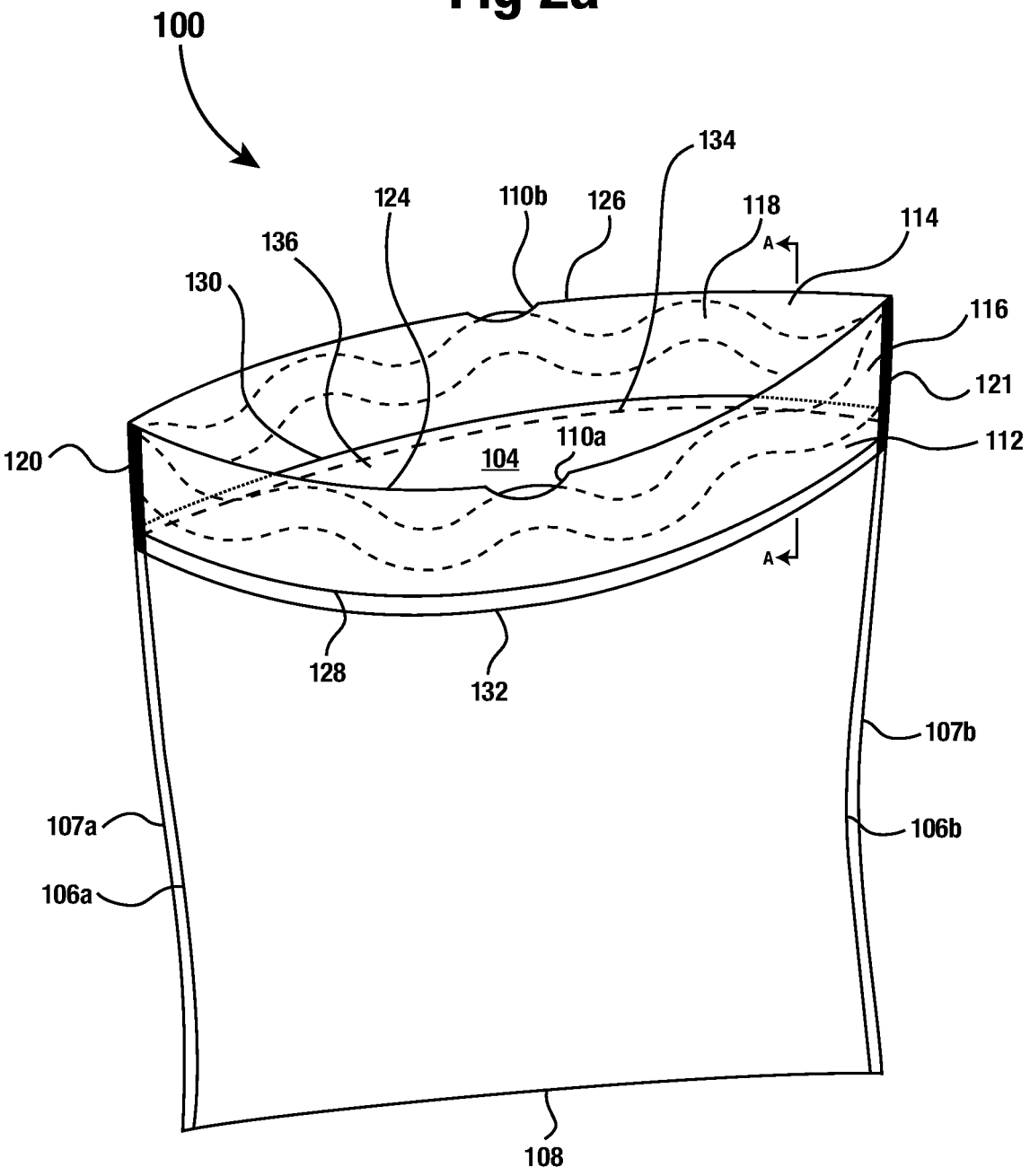

FIG. 2*a* provides a perspective view of bag 100 with gathering of the first and second hems shown and the hidden lines of the drawstrings within the first and second hems not shown.

Figure 2B:
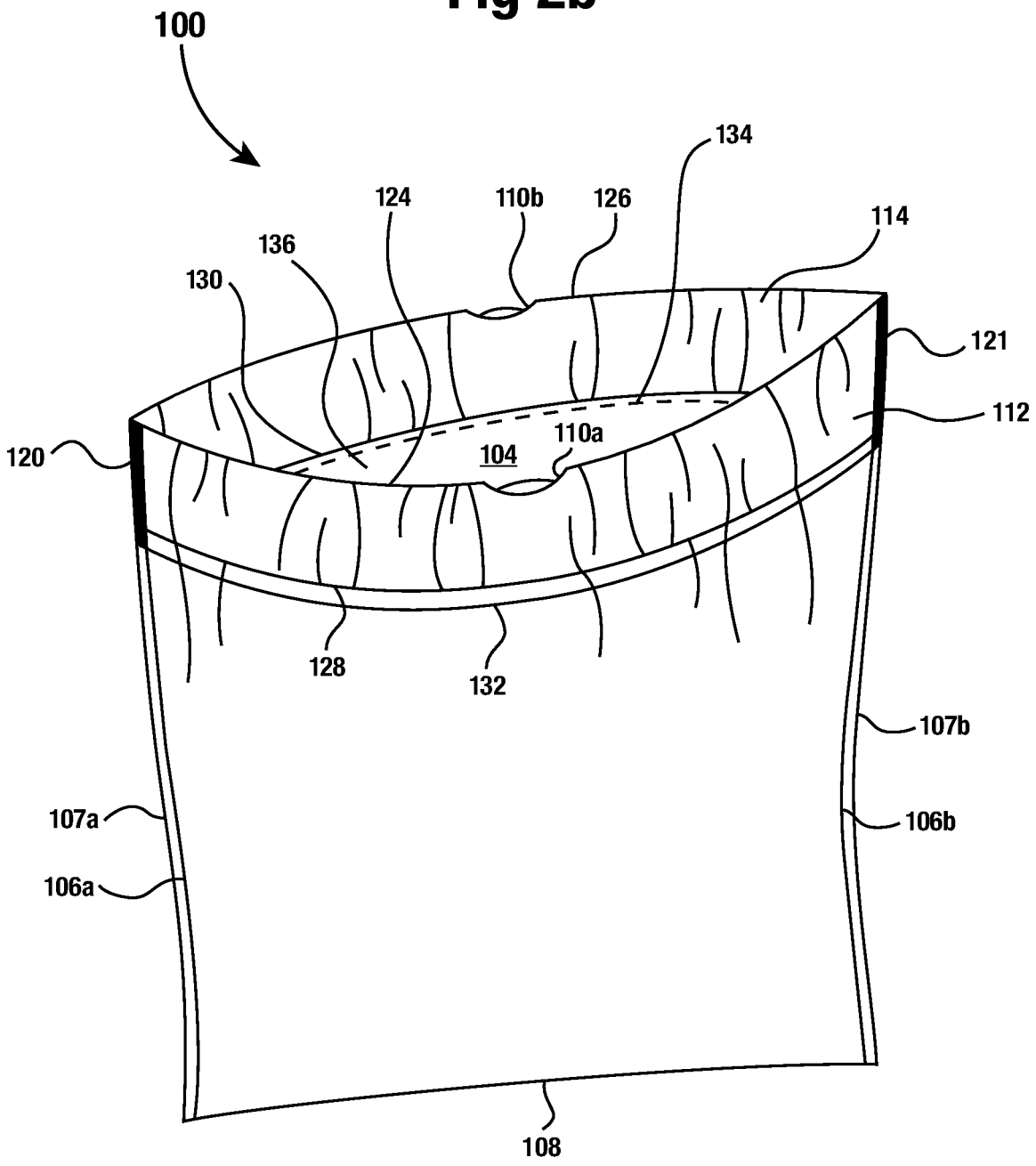

FIG. 2*b* provides an additional perspective view of bag 100 with gathering of the first and second hems shown and the hidden lines of the drawstrings within the first and second hems not shown.

Figure 3:
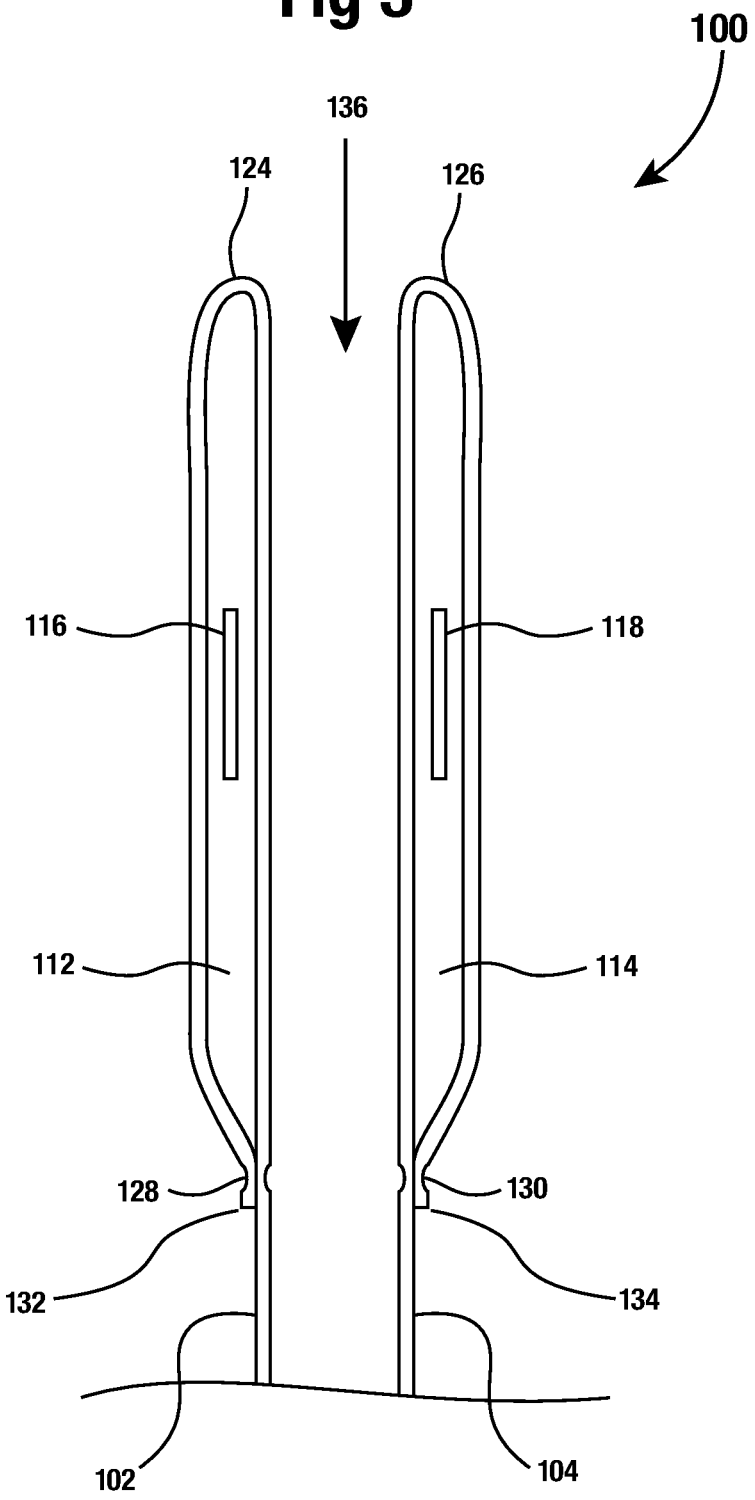

FIG. 3 provides a partial cross-sectional view of bag 100 taken along line A-A of FIG. 2*a*.

Figure 4:
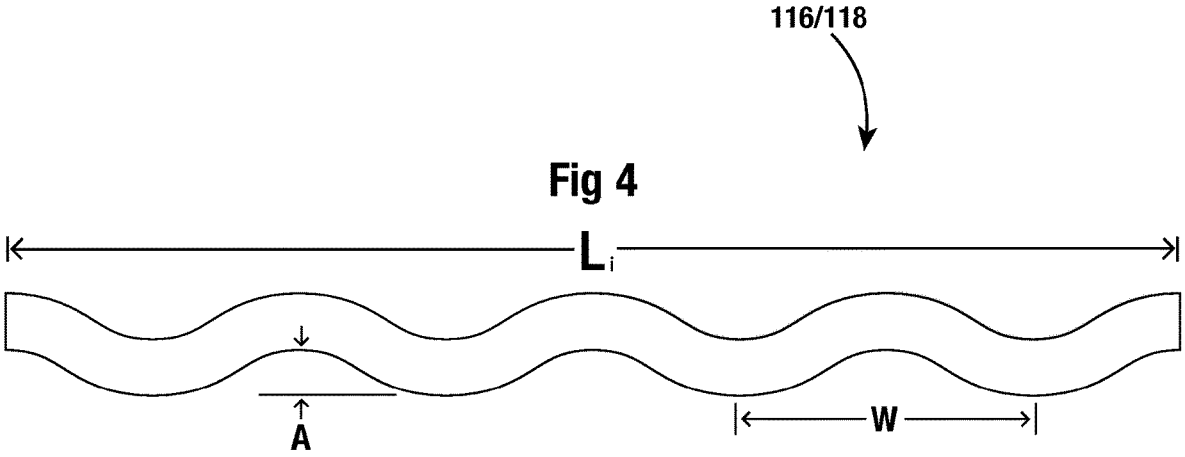

FIG. 4 provides a side view of drawstring 116/118 of bag 100 in an un-stretched state.

Figure 5:
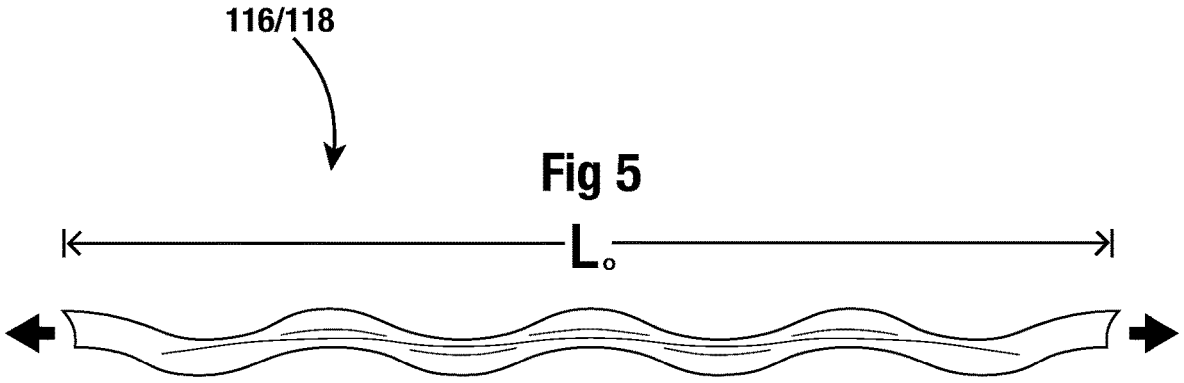

FIG. 5 provides a side view of drawstring 116/118 of bag 100 in an out-stretched state.

DETAILED DESCRIPTION OF THE INVENTION

The present disclosure illustrates one or more preferred embodiments of the present invention. It is not intended to provide an illustration or encompass all embodiments contemplated by the present invention. In view of the disclosure of the present invention contained herein, a person having ordinary skill in the art will recognize that innumerable modifications and insubstantial changes may be incorporated or otherwise included within the present invention without diverging from the spirit of the invention. Therefore, it is understood that the present invention is not limited to those embodiments disclosed herein. The appended claims are intended to more fully and accurately encompass the invention to the fullest extent possible, but it is fully appreciated that certain limitations on the use of particular terms is not intended to conclusively limit the scope of protection.

As the term is used herein, "low density polyethylene," or LDPE, is a type of polymer, specifically a category of polyethylene resins with a density between 0.910 g/cm$^3$ and 0.940 g/cm$^3$ that is comprised of a high number of both short and long chain branching along the respective polyethylene molecules.

As the term is used within this particular disclosure, "elastic," describes a relative physical property of a material.

A relatively elastic material is a material that may be elongated by tension and recover to a greater percentage to its original length than a material that is relatively inelastic. Elasticity of a polymer film may be measured by an industry accepted test, such as ASTM D-5449, known as the "Permanent Set Test." As used herein in this particular disclosure, the term relatively elastic, or elastic in general, shall refer to a material that recovers at least 80% after a 20% elongation and a relatively inelastic, or inelastic in general, material shall refer to a material that recovers less than 80% after a 20% elongation, with elastic recovery as measured by ASTM D-5449.

Now looking at FIG. 1 and FIG. 2*a*, side perspective views of a drawstring bag 100 illustrate an embodiment of the present invention. FIG. 2*b* provides an additionally perspective view of bag 100 with the hems gathered as explained further below. In the depicted embodiment, the drawstring bag 100 is manufactured from a first panel 102 and a second panel 104. First and second panels 102 and 104 are joined at bag bottom 108. Seals 106*a* and 106*b* join a first side 107*a* and a second side 107*b* of the respective first panel 102 and second panel 104 to each other. First and second panels 102 and 104 are not joined along first and second upper sides 124 and 126 which thereby define an upper opening 136 between first and second upper sides 124 and 126. While this construction of bag 100 is preferred, the invention disclosed herein is not necessarily limited to any particular manufacturing method or construction.

As part of the drawstring trash bag 100, drawstrings 116 and 118 are provided within hems 112 and 114. To provide the hems 112 and 114, upper edge 132 of the first panel 102 is folded over and sealed to form the first hem 112. Similarly, upper edge 134 of the second panel 104 is folded over and sealed to form the second hem 114. First drawstring 116 is disposed within first hem 112 and extends across the width of the first panel 102 while second drawstring 118 is disposed within the second hem 114 and extends across the width of the second panel 104.

FIG. 3, which is not to scale, is a fractional cross-section of bag 100 that depicts drawstrings 116 and 118 disposed within hems 112 and 114 formed in the drawstring trash bag 100. To provide the hems containing the drawstrings 116 and 118, the uppermost portion of the first and second panels 102 and 104 are folded over drawstrings 116 and 118, respectively. The first hem 112 is created after forming hem seal 128 on the first panel 102 while the second hem 114 is sealed by hem seal 130 on the second panel 104, encapsulating the drawstrings 116 and 118 within the respective hems 112 and 114. Hem seals 128/130 may generally be formed by applying a combination of heat and pressure to each panel, sealing the two layers of polyethylene film together on each respective panel 102 and 104.

In at least certain embodiments, first and second drawstrings 116 and 118 are constructed at least partly from an elastic polymer such as LDPE. Additionally, as best illustrated by FIG. 4, the first and second drawstrings 116 and 118 have a wave-shaped profile. In at least certain embodiments, such as shown, the waveform can be in the shape of a sinusoid. However, the waveform can take on various shapes. The wave-shaped profile can have a wavelength W extending along a length of each drawstring and an amplitude A extending along a height of each drawstring as illustrated by FIG. 4. In at least certain embodiments, each drawstring can be cut from a laminar web of film into the wave-shape. In at least certain embodiments, the web of laminar film can be formed via a cast film line or blown film extrusion. The web of film can then be formed into wave-shaped drawstrings by various methods as known in the art.

As illustrated by FIGS. 4 and 5, in at least certain embodiments, drawstrings 116 and 118 can be elongated from their initial length $L_i$ to an outstretched length $L_o$ prior to being inserted and affixed into the respective hems 112 and 114. FIG. 4 illustrates drawstring in its initial unstretched form $L_i$ and FIG. 5 illustrates drawstring in its outstretched form $L_o$. Drawstrings 116/118 can be elongated by pulling the two ends of the drawstring away from each other under tension such that the waveform flattens with the wavelength increasing and the amplitude of the waveform decreasing.

The arrows at opposite ends of drawstring 116/118 illustrate in FIG. 5 the drawstring being pulled in opposite directions which causes the drawstring to outstretch. As shown by the surface shading in FIG. 5, when drawstring 116/118 is elongated a certain amount, the drawstring deforms such that it is no longer planar. In particular, the surface shading shows the drawstring buckling and curling due to the excessive elongation.

As best shown by FIGS. 1 and 2*a*, in certain embodiments, the respective ends of the first and second drawstrings 116 and 118 are secured within hems 112 and 114 by a pair of short seals 120 and 121 provided in the upper corners of drawstring trash bag 100. The short seals 120 and 121 may generally be formed by applying a combination of heat and pressure in the locations shown in FIGS. 1 and 2*a*. Each short seal seals or welds together an upper edge of the first panel 102, the first panel 102, an end of the two drawstrings 116 and 118*a*, the second panel 104, and the upper edge of the first panel 104. In an alternative embodiment, the respective ends of the first and second 116 and 118 are secured within the hems 112 and 114 only by the side seals 106*a* and 106*b* that secure the sides of the first panel 102 to the second panel 104. In some embodiments, including a depicted preferred embodiment, a drawstring bag 100 includes central access cutouts 110*a* and 110*b*. The central access cutouts 110*a* and 110*b* allow a user to pull the drawstrings 116 and 118 through the cutouts 110*a* and 110*b* to close opening 136 of bag 100.

Elongating drawstrings 116/118 a limiting amount prior to insertion into hems 112/114, as discussed above, can lead to opening 136 of bag 100 to gather or narrow once the tension in drawstrings 116/118 is released due to drawstrings 116/118 retracting to their initial length. As shown by FIG. 2*b*, this retraction of drawstrings 116/118 can cause hems 112/114 of the bag 100 to gather such that a distance between opposing sides 107*a*/107*b* at opening 136 of bag 100 is foreshortened by the gathering; that is the distance between short seals 120/121 is decreased in comparison to fully outstretched width of bag 100.

A typical width of a drawstring for a drawstring trash bag is one-inch. In certain embodiments of the present invention the width of the wave-shaped drawstring is also an inch. At least for certain embodiments, drawstring 100 can have a length from end to end of about 24 inches. However, for embodiments of the invention where drawstring 100 is extended prior to insertion into the bag, drawstring may have a shorter length, such as between 22 and 23 inches for insertion into a bag with a nominal width of 24 inches. In at least certain embodiments of the invention, the wave shape of drawstring 100 can have a wavelength of five inches and an amplitude of an inch. However, for certain embodiments drawstring 100 can have an amplitude from about 0.75 inch to 1.5 inches. Furthermore, the wavelength of drawstring 100 can be between four and six inches at least for certain embodiments.

Drawstrings 116 and 118 having a wave-shaped profile provides certain advantages over a typical drawstring having a linear profile. For instance, the wave-shape provides for a drawstring capable of additional expansion than a typical straight drawstring. When elongated, the wave-shaped drawstring first undergoes primarily geometric deformation and flattens with its amplitude approaching zero as shown in FIG. 5. Once the wave-shaped drawstring is flattened to a considerable degree, it then experiences molecular or plastic deformation as polymeric films typically due. Due to this dual stretching mechanism, the draw tape elongates more for a given load than a linear draw tape.

For instance, testing under ASTM test method D882 has shown that a six-inch-long section of a wave-shaped drawstring elongates to about ¾ inch at 5 pounds of force. In contrast to this, a traditional linear drawstring with the same thickness and width elongates to only approximately ¼ inch with the same 5-pound force, when tested under this same test methodology. Additionally, the wave-shaped drawstring of the same length required 3.3 pounds to stretch one inch under ASTM test method D5459, while the linear drawstring requires 5 pounds of force to stretch the same one inch utilizing the same test method.

Because the wave-shaped drawstring expands more for a given force, it can be configured to fit snugly over a greater range of trash containers. Furthermore, with the wave-shaped drawstring requiring less force to expand, it requires less effort to stretch over larger trash containers. Although the wave-shaped drawstring requires less effort to expand, it provides enough resistance or tension to hold in place a trash bag once the bag has been stretched over the same size range of trash containers as a linear drawstring. Furthermore, because the wave-shaped drawstring has the same thickness and width, it can carry the same ultimate load as the comparable linear drawstring.

As noted, the embodiments depicted herein are not intended to limit the scope of the present invention. Indeed, it is contemplated that any number of different embodiments may be utilized without diverging from the spirit of the invention. Therefore, the appended claims are intended to more fully encompass the scope of the present invention.

What is claimed is:

1. A drawstring bag comprising:

a first panel and a second panel, the first panel and the second panel joined along a first side, a bottom, and a second side, the first panel and the second panel thereby defining an upper opening of the bag, a first hem located along the upper opening of the bag in the first panel, the first hem extending between the upper opening and a first hem seal, a first drawstring of laminar film disposed within the first hem, the surface of the first drawstring generally flat and undeformed, the first drawstring having a wave-shape, an amplitude of the wave-shape extending between the upper opening and the first hem seal, the first panel, the second panel, and the first drawstring welded together proximate to the first side, and the first panel, the second panel, and the first drawstring welded together proximate to the second side.

2. The drawstring bag of claim 1 further comprising:

the wave-shape of the first drawstring elongated such that the wave-shape is deformed.

3. The drawstring bag of claim 1 further comprising:

first panel, the second panel, and the first drawstring welded together proximate to the first side by a first short seal.

4. The drawstring bag of claim 3 further comprising:

the first panel, the second panel, and the first drawstring welded together proximate to the second side by a second short seal.

5. The drawstring bag of claim 1 further comprising:

the first drawstring elastic and the wave-shape sinusoidal.

6. The drawstring bag of claim 1 further comprising:

the upper opening of the bag narrowed due to the first drawstring retracting after attachment to the bag.

7. The drawstring bag of claim 1 further comprising:

the first drawstring having a width between ¾ inch and 1¼ inch.

8. The drawstring bag of claim 7 further comprising:

the amplitude of the first drawstring at least ¾ inch and no more than 1.5 inches.

9. The drawstring bag of claim 8 further comprising:

the wavelength of the first drawstring at least four inches and no more than six inches.

10. A drawstring bag comprising:

a first panel and a second panel, the first panel and the second panel joined along a first side, a bottom, and a second side, the first panel and the second panel thereby defining an upper opening of the bag, a first hem located along the upper opening of the bag in the first panel, the first hem extending between the upper opening and a first hem seal in the first panel, the first hem seal below the upper opening, a first drawstring disposed within the first hem, the first drawstring having a wave-shape, wherein the wave-shape comprises an elongated sine wave, the elongated sine wave comprising an amplitude and a wavelength, the amplitude comprising a plurality of peaks and troughs, the plurality of peaks adjacent to the upper opening and not adjacent to the first hem seal, the plurality of troughs adjacent to first hem seal and not adjacent to the upper opening, the first panel, the second panel, and the first drawstring welded together proximate to the first side, and the first panel, the second panel, and the first drawstring welded together proximate to the second side.

11. The drawstring bag of claim 10 further comprising:

first panel, the second panel, and the first drawstring welded together proximate to the first side by a first short seal.

12. The drawstring bag of claim 11 further comprising:

the first panel, the second panel, and the first drawstring welded together proximate to the second side by a second short seal.

13. The drawstring bag of claim 10 further comprising:

the upper opening of the bag narrowed due to the first drawstring retracting after attachment to the bag.

14. The drawstring bag of claim 10 further comprising:

the first drawstring having a width between ¾ inch and 1¼ inch.

15. The drawstring bag of claim 14 further comprising:

the amplitude of the first drawstring at least ¾ inch and no more than 1.5 inches.

16. The drawstring bag of claim 15 further comprising:

the wavelength of the first drawstring at least four inches and no more than six inches.

17. A drawstring bag comprising:

a first panel and a second panel, the first panel and the second panel joined along a first side, a bottom, and a second side, the first panel and the second panel thereby defining an upper opening of the bag, a first hem located along the upper opening of the bag in the first panel, the first hem extending between the upper opening and a first hem seal, a first drawstring disposed within the first hem, the first drawstring having a geometric wave-shape, the wave-shape having an amplitude and a wavelength, a geometric first hem plane defined by a first line extending along the upper opening and a second line extending along the first hem seal, an entirety of a surface of the first drawstring extending generally parallel to the first hem plane such that the amplitude and wavelength extend generally parallel to the first hem plane, the upper opening of the bag narrowed due to the first drawstring retracting after attachment to the bag, the first panel, the second panel, and the first drawstring welded together proximate to the first side, and the first panel, the second panel, and the first drawstring welded together proximate to the second side.

18. The drawstring bag of claim 17 further comprising:

first panel, the second panel, and the first drawstring welded together proximate to the first side by a first short seal.

19. The drawstring bag of claim 18 further comprising:

the first panel, the second panel, and the first drawstring welded together proximate to the second side by a second short seal.

20. The drawstring bag of claim 17 further comprising:

the first drawstring elastic and the wave shape sinusoidal.

* * * * *